US009393479B1

(12) United States Patent
Park

(10) Patent No.: US 9,393,479 B1
(45) Date of Patent: Jul. 19, 2016

(54) ARCHERY ARM GUARD SYSTEM

(71) Applicant: Robert Park, Asheville, NC (US)

(72) Inventor: Robert Park, Asheville, NC (US)

( * ) Notice: Subject to any disclaimer, the term of this patent is extended or adjusted under 35 U.S.C. 154(b) by 0 days.

(21) Appl. No.: 14/447,445

(22) Filed: Jul. 30, 2014

Related U.S. Application Data

(60) Provisional application No. 61/859,911, filed on Jul. 30, 2013.

(51) Int. Cl.

| | |
|---|---|
| ***A41D 13/08*** | (2006.01) |
| ***A41D 13/015*** | (2006.01) |
| ***A62B 17/00*** | (2006.01) |
| ***F41H 1/00*** | (2006.01) |
| ***G21F 3/02*** | (2006.01) |
| ***A63B 71/14*** | (2006.01) |

(52) U.S. Cl.
CPC ..... *A63B 71/14* (2013.01); *A41D 13/08* (2013.01)

(58) Field of Classification Search
CPC ... A41D 13/08; A41D 13/081; A41D 13/084; A41D 13/088; A63B 71/14; A63B 71/08; A63B 71/12; A63B 2244/04; A63B 69/3508; A61F 5/0118; F41B 5/14; F41B 5/1473; Y10S 2/91
USPC ..... 2/1, 16, 20, 455, 910
See application file for complete search history.

(56) References Cited

U.S. PATENT DOCUMENTS

| | | | | | |
|---|---|---|---|---|---|
| 692,088 | A * | 1/1902 | Stoner | A47J 17/02 | 2/16 |
| 701,445 | A * | 6/1902 | Wood | A41D 13/08 | 2/59 |
| 770,619 | A * | 9/1904 | Waller | A47J 17/02 | 2/16 |
| 3,002,192 | A * | 10/1961 | Brower | F41B 5/1473 | 2/16 |
| 3,304,555 | A * | 2/1967 | Anderson | A41D 13/08 | 124/23.1 |
| 3,703,728 | A * | 11/1972 | Saunders | A41D 13/08 | 2/16 |
| 4,048,674 | A * | 9/1977 | Chesnick | A41D 13/08 | 2/16 |
| 4,097,931 | A | 7/1978 | Hirose | | |
| 4,373,213 | A * | 2/1983 | Erlandson | A41D 13/08 | 2/16 |
| 5,784,715 | A * | 7/1998 | Buchanan | A63B 71/1225 | 2/22 |
| 6,374,408 | B1 * | 4/2002 | Tomlinson | A41D 13/0568 | 2/16 |
| 2006/0172812 | A1 * | 8/2006 | Kraus | A63B 69/3608 | 473/212 |
| 2010/0083415 | A1 * | 4/2010 | Beckford | A41D 13/08 | 2/16 |

* cited by examiner

*Primary Examiner* — Alissa L Hoey
*Assistant Examiner* — Jameson Collier

(57) ABSTRACT

An archery arm guard system for protecting an arm of an archer features a panel. A panel posterior edge features a concave arcuate shape. The panel is constructed from a low-friction flexible material. The system features a first aperture, a second aperture, a third aperture, and a fourth aperture. The system features a first retaining strap and a second retaining strap with a first strap first component located in the first aperture and a first strap second component located in the second aperture. A second strap first component is located in the third aperture and a second strap second component is located in the fourth aperture.

1 Claim, 9 Drawing Sheets

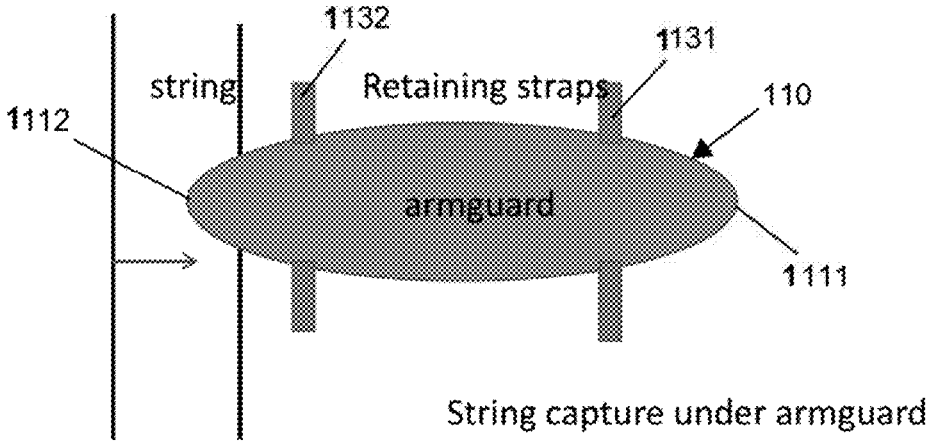
FIG. 6 - PRIOR ART
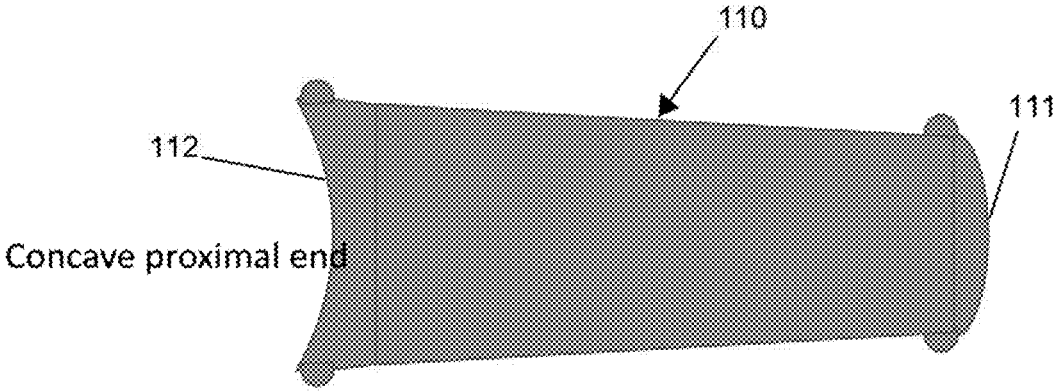
FIG. 7 - THE PRESENT INVENTION

ARCHERY ARM GUARD SYSTEM

CROSS REFERENCE

This application claims priority to Provisional U.S. Patent Application No. 61/859,911, filed Jul. 30, 2013, the specification(s) of which is/are incorporated herein in their entirety by reference.

FIELD OF THE INVENTION

The present invention relates to archery components or more specifically, arm guards used in archery.

BACKGROUND OF THE INVENTION

Arm guards for the sport of archery have been used for years to protect archers from the trauma of a string striking an arm. When the string strikes the arm, lacerations, contusions, or abrasions may result. Modern materials have led to a number of different designs, but none have been completely successful at protecting the arm. Additionally, when the bow string strikes the arm guard, string movement and harmonics are affected with a net result of affecting arrow flight. Thus, arrows become inaccurate and inconsistent. The present invention features an archery arm guard system for protecting the arm of the archer.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an archery arm guard system for protecting an arm of an archer. In some embodiments, the system comprises a panel. In some embodiments, a panel posterior edge comprises a concave arcuate shape. In some embodiments, the panel is constructed from a low-friction flexible material. In some embodiments, the panel comprises a panel thickness from a panel inner surface to a panel outer surface between 0.0005 inches and 0.5 inches.

In some embodiments, the system comprises a first aperture, a second aperture, a third aperture, and a fourth aperture. In some embodiments, the system comprises a first retaining strap and a second retaining strap. In some embodiments, a first strap first component is located in the first aperture. In some embodiments, a first strap second component is located in the second aperture. In some embodiments, a second strap first component is located in the third aperture. In some embodiments, a second strap second component is located in the fourth aperture.

In some embodiments, the panel inner surface is placed against the arm of the archer. In some embodiments, a panel anterior edge is located proximate to a wrist of the archer. In some embodiments, the panel posterior edge is located proximate to an elbow of the archer. In some embodiments, the first strap first component and the first strap second component wrap around the arm of the archer and attach to hold the panel in place on the arm of the archer. In some embodiments, the second strap first component and the second strap second component wrap around the arm of the archer and attach to hold the panel in place on the arm of the archer.

BRIEF DESCRIPTION OF THE DRAWINGS

FIG. 6 shows a diagram of the prior art.
FIG. 7 shows a diagram of the present invention.

DESCRIPTION OF PREFERRED EMBODIMENTS

Figure 1:
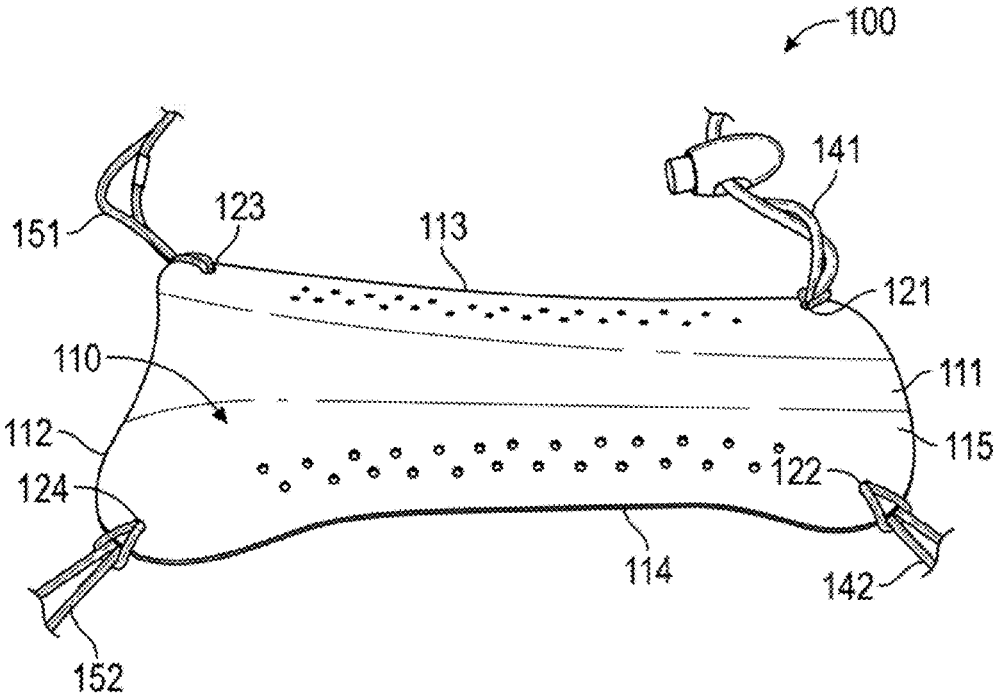
FIG. 1 shows a perspective view of the present invention.
Figure 2:
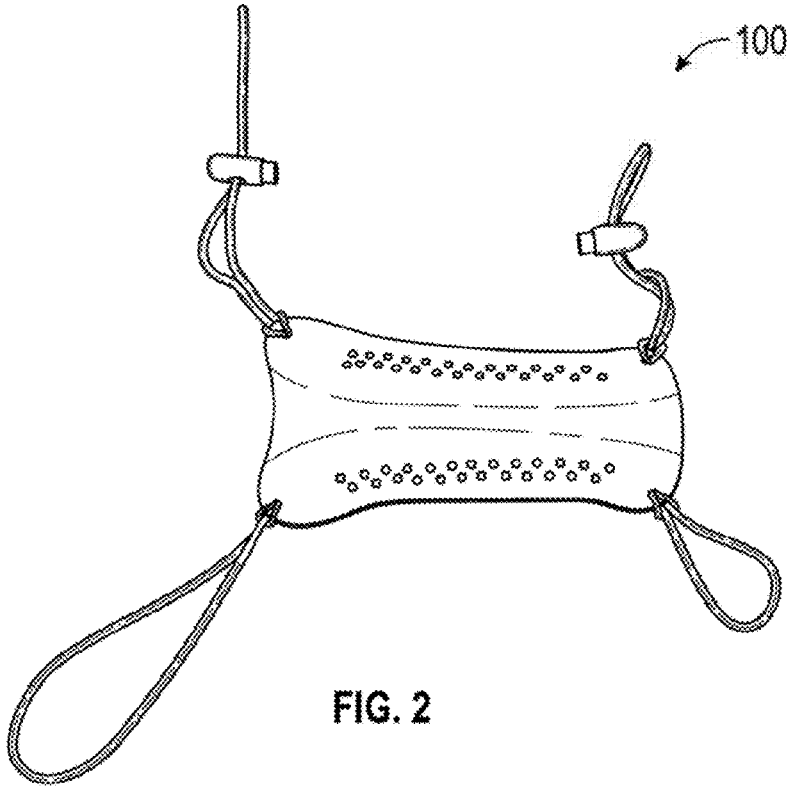
FIG. 2 shows a top view of the present invention.
Figure 3:
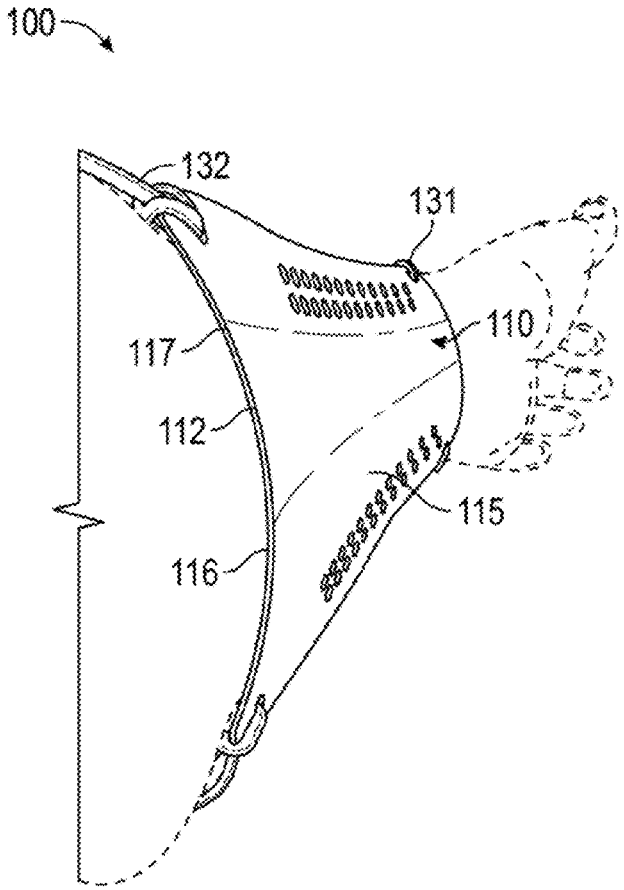
FIG. 3 shows a side view of the present invention in use.
Figure 4:
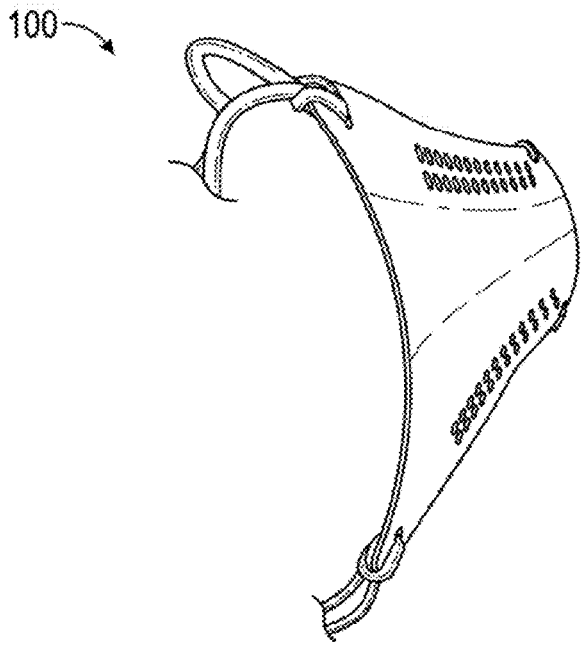
FIG. 4 shows a side view of the present invention.
Figure 5:
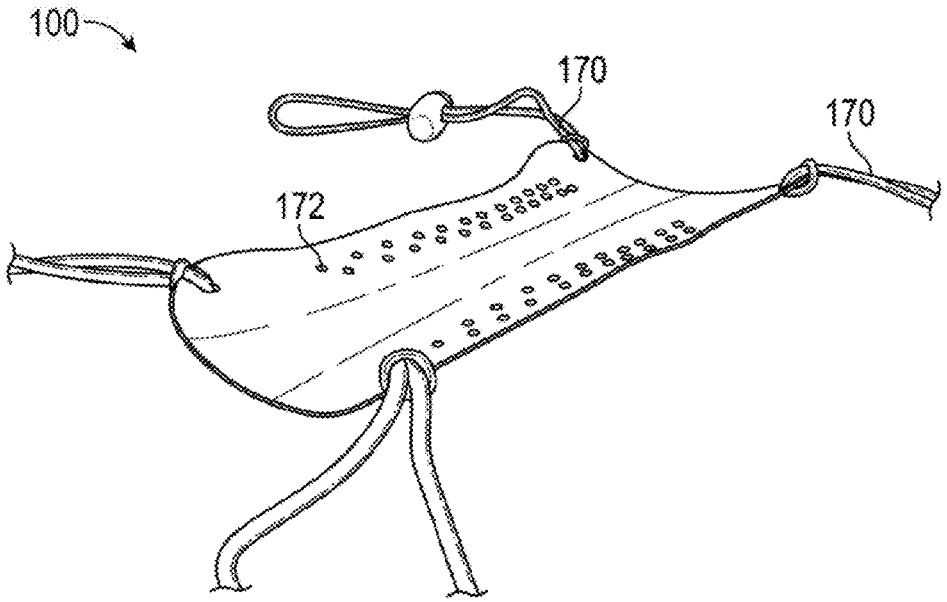
FIG. 5 shows a perspective view of the present invention.
Figure 8:
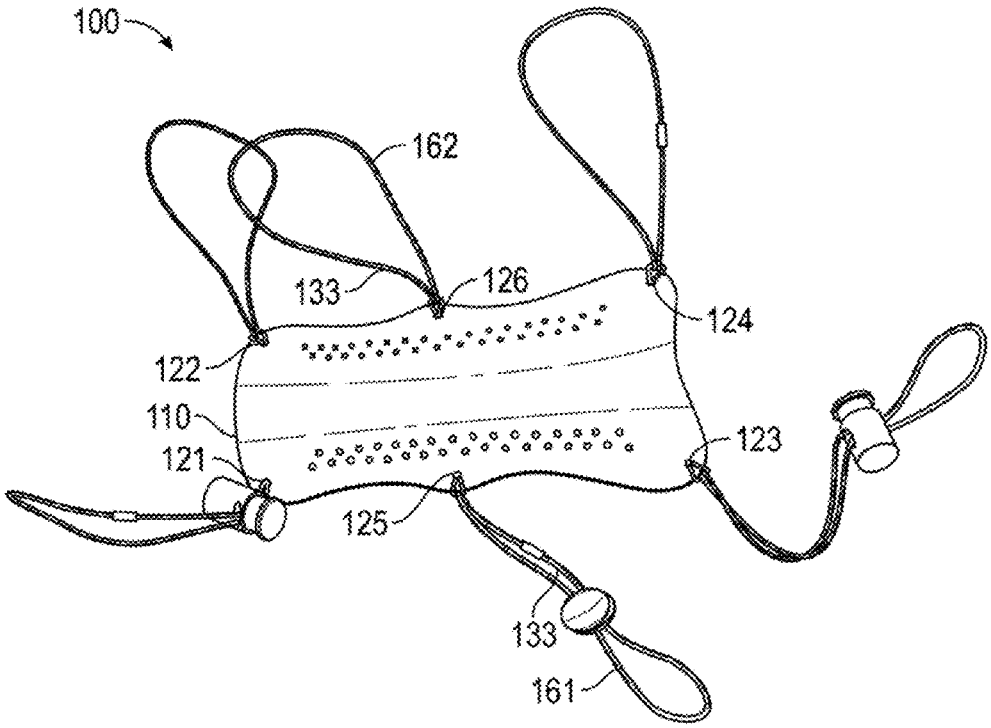
FIG. 8 shows a top view of an alternate embodiment of the present invention.
Figure 9:
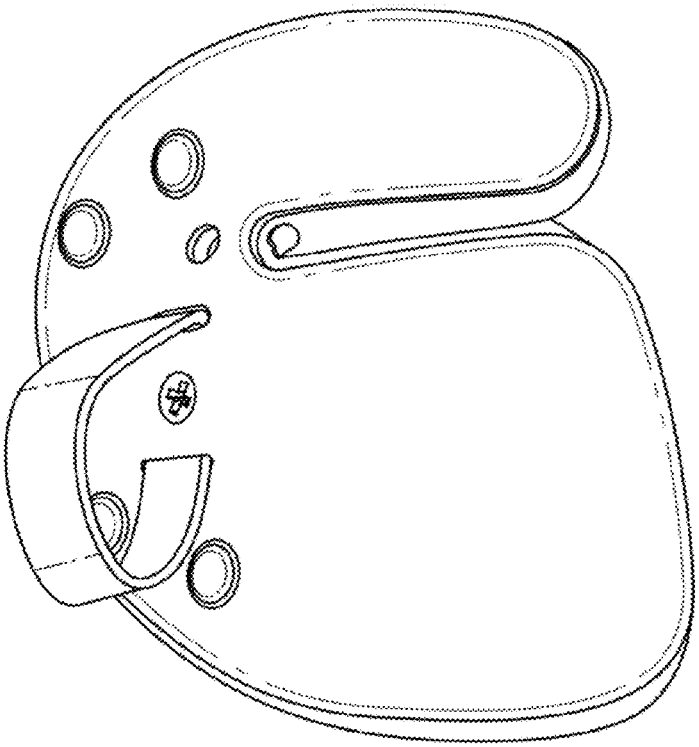
FIG. 9 shows a front view of a finger tab of the present invention.
Figure 10:
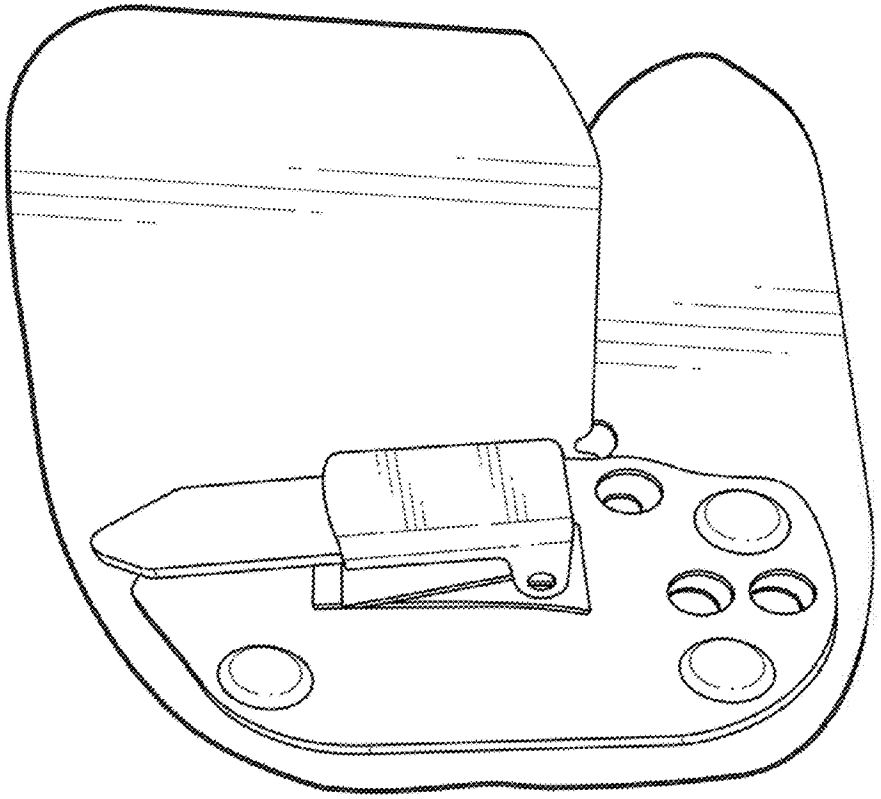
FIG. 10 shows a rear view of a finger tab of the present invention.
Figure 11:
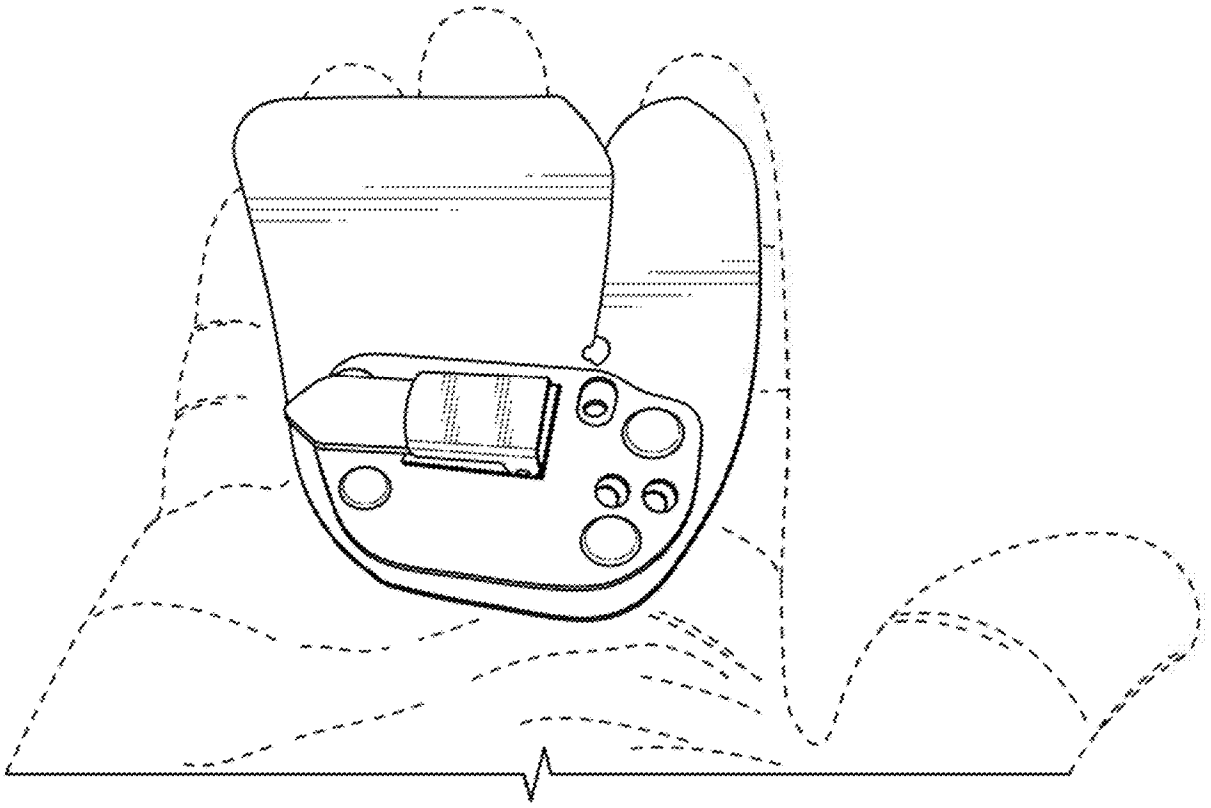
FIG. 11 shows a rear view of a finger tab of the present invention in use.
Figure 12:
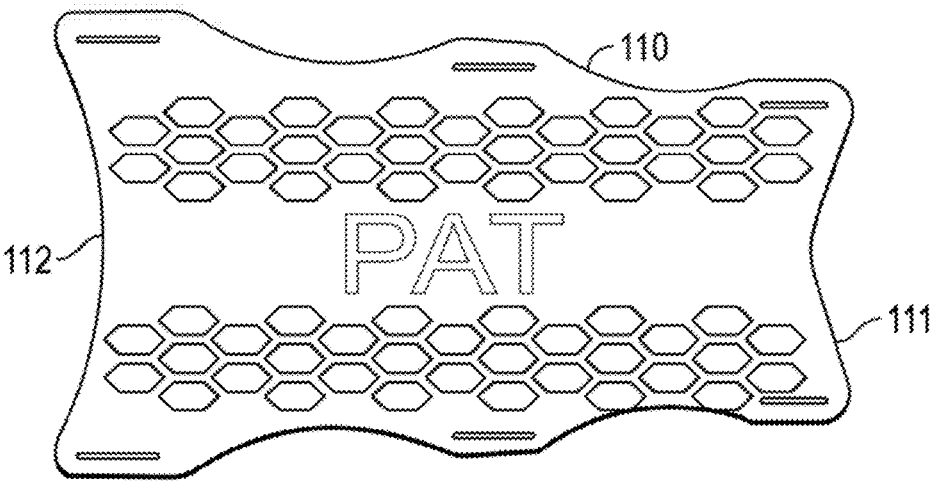
FIG. 12 shows an alternate embodiment of the present invention.

Following is a list of elements corresponding to a particular element referred to herein:

100 Archery arm guard system
110 Panel
111 Panel anterior edge
112 Panel posterior edge
113 Panel first side edge
114 Panel second side edge
115 Panel outer surface
116 Panel inner surface
117 Panel thickness
121 First aperture
122 Second aperture
123 Third aperture
124 Fourth aperture
125 Fifth aperture
126 Sixth aperture
131 First retaining strap
132 Second retaining strap
133 Third retaining strap
141 First strap first component
142 First strap second component
151 Second strap first component
152 Second strap second component
161 Third strap first component
162 Third strap second component
170 Attachment means
172 Aperture Referring now to FIG. 1-12, the present invention features a novel arm guard system.

Introduction:

Arm guards for the sport of archery have been used for years to protect archers from the trauma of a string striking the arm. When the string strikes the arm, lacerations, contusions, or abrasions may result. Modern materials have led to a number of different designs, but none have been completely successful at protecting the arm. Additionally, when the bow string strikes the armguard, string movement and harmonics are affected with the net result of affecting arrow flight and making arrows inaccurate and inconsistent.

Devices designed to protect the arm in addition to affecting arrow flight may also accelerate string breakdown and failure because of friction related damage.

Here, we introduce a new armguard design that is novel in shape and materials. It is designed to protect the arm from traumatic damage, to reduce the effect that an arm strike has on arrow dynamics and flight, and to protect the string from damage.

Problems with Existing Designs:

Arm Protection:

A number of designs have been manufactured to try to protect an archer's arm from the trauma of a string strike. Simple sleeve style armguards can protect the arm but can be bulky and may not conform to the arm properly due to thickness or rigidness; they may result in an increased number of arm strikes because of the nonconformity. Partial coverage armguards may protect the arm but again do not conform well to the arm during shooting because of the rigidness of the armguard and movement of the arm during shooting.

A typical mode of arm injury in spite of arm guard installation occurs when the string strikes the proximal end of the arm guard and the string moves under the arm guard hitting the arm and causing injury. Current arm guard designs have a proximal end with a straight or convex design that allows an undesired capture of the bow string.

Placement of retaining straps distal from the proximal end of the arm guard can compound the string capture problem, resulting in more traumatic damage to the arm. The solution to the string capture problem is to change the shape of the proximal end of the armguard to a concave shape and to place the restraining strap in close proximity. When the armguard conforms to the shape of the arm, it develops an arc-like cross-section with a sloping concave proximal end. As the bowstring strikes the end of the armguard, it is guided onto the surface of the armguard instead of striking the end of the arm guard and displacing it as would happen with a straight proximal end or being guided under it as would happen with a convex or straight proximal end.

Hence the first novel feature of the design: the arm guard has a concave proximal end with closely adjacent retaining straps that allows the string to be guided onto the surface of the armguard when the string strikes the end of the arm guard.

Friction generated when the string strikes the arm and protection of the string:

The second feature of the armguard is the material from which it is made. When a bowstring strikes an armguard, the string direction, speed, and harmonics are affected. The result is an inaccurate arrow that may miss the target or create inconsistency in a series of arrows. Use of a low friction polymer such as but not limited to polytetrafluoroethylene (PTFE, e.g., TEFLON™), fluorinated ethylene propylene, and perfluoroalkoxy, and silicone rubber allows the arrow to strike the arm guard with a minimal effect on arrow flight. Additionally, tests have demonstrated that the low friction material guards against wear on the bow string resulting in a longer lasting string.

The arm guard may be made from solid low friction polymer sheet or tube, or may be low friction polymer bonded to cloth, leather, or other material. Additionally the polymer may be used as a coating on cloth, leather, metals, or other materials. The low friction polymer may also be expanded and breathable such as expanded PTFE. Additionally the armguard may be incorporated into clothing such as sleeves of shirts or jackets by stitching, coating, or direct incorporation into clothing fibers.

Lack of Conformity to the Arm:

Thick armguards may not conform to the shape of the arm, especially when the arm moves as the bow is raised. Thus, the third feature of the armguard is its' thinness. The arm guard may be made of low-friction polymer sheet in a thickness ranging from 0.0005 inches to 0.5 inch. The thin and flexible material allows for better conformity to the arm and decreases the likelihood of an arm strike. This may result in a decreased likelihood of arm damage or aberrant arrow flight.

The preferred embodiment of the armguard uses a thickness of 1/32".

Finger Tab:

The purpose of the finger tab is to protect the fingers from frictional forces generated when the string is released. Traditional finger tabs are constructed from leather with/without a metal base and have a finger spacer. The new design has a layer of PTFE or other low friction material that contacts the string and minimizes string-finger friction. Testing reveals that arrow velocities are faster compared to a traditional finger tab, resulting in a flatter trajectory, shorter travel time, and more accurate shot.

PTFE Coated String Release:

A release device is used in compound archery to achieve a more accurate shot. The device consists of a hinged hook to hold the string. The hinge is allowed to swing, resulting in a release of the string or string loop. The new device focuses on the metal or plastic hook that holds the string or string loop. In the new release, the release is coated with PTFE or is created from PTFE, allowing increased arrow velocity, flatter arrow trajectory, and a more accurate shot.

Chest Guard:

The chest guard is used to minimize interaction between the string and clothing or tissue. Constructing a chest guard from low friction materials such as polytetrafluoroethylene (PTFE, e.g., TEFLON™), expanded PTFE, fluorinated ethylene propylene, perfluoroalkoxy, or silicone rubber.

Summary of Novel Features:

An archery arm guard with a concave shaped proximal end with adjacent restraining straps to reduce the risk of arm strikes. An archery arm guard made of a low friction polymer such as PTFE. This may be an expanded material, fused material, coating, or direct low friction fiber construction. An archery arm guard made to be thin and flexible to allow conformity to the arm. The armguard may be independent or incorporated into a shirtsleeve, jacket, or other article of clothing.

The present invention features an archery arm guard system (100) for protecting an arm of an archer. In some embodiments, the system (100) comprises a panel (110) having a panel anterior edge (111), a panel posterior edge (112), a panel first side edge (113), a panel second side edge (114), a panel outer surface (115), and a panel inner surface (116). In some embodiments, the panel posterior edge (112) comprises a concave arcuate shape. In some embodiments, the panel (110) is constructed from a low-friction flexible material. In some embodiments, the panel (110) is constructed from woven or braided low-friction polymer fiber. In some embodiments, the material is semi-flexible. In some embodiments, the material is semi-rigid. In some embodiments, the material comprises a shore D hardness on a hardness scale as measured by a durometer. In some embodiments, the panel (110) comprises a panel thickness (117) from the panel inner surface (116) to the panel outer surface (115) between 0.0005 inches and 0.5 inches. In some embodiments, the panel (110) is constructed from a rigid material.

In some embodiments, the panel (110) comprises a curved shape to match a shape of the arm of the archer from the panel first side edge (113) to the panel second side edge (114). In some embodiments, the panel (110) comprises perforations. In some embodiments, the panel (110) comprises perforations located along the panel first side edge (113) and the panel second side edge (114). In some embodiments, the perforations are complex or simple geometric shapes, such as a polygon or the like. In some embodiments, perforations cover the entire panel (110). In some embodiments, the panel comprises rounded corners. In some embodiments, the panel comprises a smooth finish. In some embodiments, the panel anterior edge (111) comprises a convex arcuate shape. In some embodiments, the panel anterior edge (111) comprises a concave arcuate shape. In some embodiments, the panel first side edge (113) comprises a concave arcuate shape. In some embodiments, the panel second side edge (114) comprises a concave arcuate shape.

In some embodiments, the system (100) comprises a first aperture (121), a second aperture (122), a third aperture (123), and a fourth aperture (124). In some embodiments, the first aperture (121) is located on the panel (110) close to an intersection of the panel anterior edge (111) and the panel first side edge (113). In some embodiments, the second aperture (122) is located on the panel (110) close to an intersection of the panel anterior edge (111) and the panel second side edge (114). In some embodiments, the third aperture (123) is located on the panel (110) close to an intersection of the panel posterior edge (112) and the panel first side edge (113). In some embodiments, the fourth aperture (124) is located on the panel (110) close to an intersection of the panel posterior edge (112) and the panel second side edge (114).

In some embodiments, the system (100) comprises a first retaining strap (131) having a first strap first component (141) and a mated first strap second component (142), and a second retaining strap (132) having a second strap first component (151) and a mated second strap second component (152). In some embodiments, the first strap first component (141) is located in the first aperture (121). In some embodiments, the first strap second component (142) is located in the second aperture (122). In some embodiments, the second strap first component (151) is located in the third aperture (123). In some embodiments, the second strap second component (152) is located in the fourth aperture (124).

In some embodiments, the panel inner surface (116) is placed against an arm of an archer. In some embodiments, the panel anterior edge (111) is located close to a wrist of the archer. In some embodiments, the panel posterior edge (112) is located close to an elbow of the archer. In some embodiments, the first strap first component (141) and the first strap second component (142) wrap around the arm of the archer and attach to hold the panel (110) in place on the arm of the archer. In some embodiments, the second strap first component (151) and the second strap second component (152) wrap around the arm of the archer and attach to hold the panel (110) in place on the arm of the archer.

In some embodiments, the system (100) comprises a fifth aperture (125) and a sixth aperture (126). In some embodiments, the fifth aperture (125) is located on the panel midway between the first aperture (121) and the third aperture (123). In some embodiments, the sixth aperture (126) is located on the panel (110) midway between the second aperture (122) and the fourth aperture (124).

In some embodiments, the system (100) comprises a third retaining strap (133) having a third strap first component (161) and a mated third strap second component (162). In some embodiments, the third strap first component (161) is located in the fifth aperture (125). In some embodiments, the third strap second component (162) is located in the sixth aperture (126).

In some embodiments, the third strap first component (161) and the third strap second component (162) wrap around the arm of the archer and attach to hold the panel (110) in place on the arm of the archer.

In some embodiments, the first strap first component (141) and the first strap second component (142) are constructed form elastic. In some embodiments, the first strap first component (141) and the first strap second component (142) are contiguous and are constructed form elastic. In some embodiments, the second strap first component (151) and the second strap second component (152) are constructed form elastic. In some embodiments, the second strap first component (151) and the second strap second component (152) are contiguous and are constructed form elastic. In some embodiments, the third strap first component (161) and the third strap second component (162) are constructed form elastic. In some embodiments, the third strap first component (161) and the third strap second component (162) are contiguous and are constructed form elastic.

The present invention features an archery arm guard system (100) for protecting an arm of an archer. In some embodiments, the system (100) comprises a panel (110) having a panel anterior edge (111), a panel posterior edge (112), a panel first side edge (113), a panel second side edge (114), a panel outer surface (115), and a panel inner surface (116). In some embodiments, the panel posterior edge (112) comprises a concave arcuate shape. In some embodiments, the panel (110) is constructed from a low-friction flexible material.

In some embodiments, the panel inner surface (116) is placed against an arm of a archer. In some embodiments, the panel anterior edge (111) is located close to a wrist of the archer. In some embodiments, the panel posterior edge (112) is located close to an elbow of the archer. In some embodiments, the panel (110) is held in place on the arm of the archer via a temporary attachment means (170).

In some embodiments, an aperture (172) is located on the panel (110).

In some embodiments, a first series of apertures (172) is located on the panel (110) on an axis parallel to a panel first side edge (113).

In some embodiments, a second series of apertures (172) is located on the panel (110) on an axis parallel to a panel second side edge (114).

In some embodiments, the panel (110) is trapezoidal.

In some embodiments, the trapezoidal panel (110) tapers in width from the panel posterior edge (112) to the panel anterior edge (111). In some embodiments, the panel posterior edge (112) is wider than the panel anterior edge (111).

In some embodiments, the panel (110) is constructed from a low-friction polymer. In some embodiments, the panel (110) is constructed from a low-friction polymer layered on or attached to cloth, leather, other materials, or the like. In some embodiments, the panel (110) is constructed from TEFLON®. In some embodiments, the panel (110) is constructed from TEFLON® backed with microfiber. In some embodiments, the panel (110) is constructed from silicone. In some embodiments, the panel (110) is constructed from TEFLON® having a silicone surrounding edge.

In some embodiments, the present invention features a method of protecting an arm of an archer from traumatic damage, reducing the effect that an arm strike has on arrow dynamics and flight, and protecting the string from damage.

In some embodiments, the method comprises obtaining an archery arm guard system (100) for protecting an arm of an archer.

In some embodiments, the system (100) comprises a trapezoidal panel (110) having a panel anterior edge (111), a panel posterior edge (112), a panel first side edge (113), a panel second side edge (114), a panel outer surface (115), and a panel inner surface (116). In some embodiments, the trapezoidal panel (110) tapers in width from the panel posterior edge (112) to the panel anterior edge (111). In some embodiments, the panel posterior edge (112) is wider than the panel anterior edge (111). In some embodiments, the panel posterior edge (112) comprises a concave arcuate shape having each end corner of the panel posterior edge (112) extending past a midpoint of the panel posterior edge (112). In some embodiments, the panel (110) is constructed from a low-friction flexible material. In some embodiments, the panel (110) comprises a panel thickness (117) from the panel inner surface (116) to the panel outer surface (115) between 0.0005 inches and 0.5 inches; a first aperture (121), a second aperture (122), a third aperture (123), and a fourth aperture (124). In some embodiments, the first aperture (121) is located on the panel (110) close to an intersection of the panel anterior edge (111) and the panel first side edge (113). In some embodiments, the second aperture (122) is located on the panel (110) close to an intersection of the panel anterior edge (111) and the panel second side edge (114). In some embodiments, the third aperture (123) is located on the panel (110) close to an intersection of the panel posterior edge (112) and the panel first side edge (113). In some embodiments, the fourth aperture (124) is located on the panel (110) close to an intersection of the panel posterior edge (112) and the panel second side edge (114); and a first retaining strap (131) having a first strap first component (141) and a mated first strap second component (142), and a second retaining strap (132) having a second strap first component (151) and a mated second strap second component (152). In some embodiments, the first strap first component (141) is located in the first aperture (121). In some embodiments, the first strap second component (142) is located in the second aperture (122). In some embodiments, the second strap first component (151) is located in the third aperture (123). In some embodiments, the second strap second component (152) is located in the fourth aperture (124).

In some embodiments, the method comprises placing the panel inner surface (116) against an arm of a archer. In some embodiments, the panel anterior edge (111) is located close to a wrist of the archer. In some embodiments, the panel posterior edge (112) is located close to an elbow of the archer. In some embodiments, the first strap first component (141) and the first strap second component (142) wrap around the arm of the archer and attach to hold the panel (110) in place on the arm of the archer. In some embodiments, the second strap first component (151) and the second strap second component (152) wrap around the arm of the archer and attach to hold the panel (110) in place on the arm of the archer.

In some embodiments, the method comprises operating a bow and arrow.

In some embodiments, the method protects an arm of an archer from traumatic damage, reduces the effect that an arm strike has on arrow dynamics and flight, and protects the string from damage when operating the bow and arrow.

As used herein, the term "about" refers to plus or minus 10% of the referenced number.

The disclosures of the following U.S. Patents are incorporated in their entirety by reference herein: U.S. Pat. No. 4,373,213; U.S. Pat. No. 4,097,931; and U.S. Pat. No. 4,048,674.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An archery arm guard system (100) for protecting an arm of an archer, the system (100) consisting of:

a trapezoidal panel (110) having a panel anterior edge (111), a panel posterior edge (112), a panel first side edge (113), a panel second side edge (114), a panel outer surface (115), and a panel inner surface (116), wherein the panel posterior edge (112) consists of a concave arcuate shape from a perspective perpendicular to the panel outer surface; wherein when a bowstring strikes the panel posterior edge (112), the concave panel posterior edge guides the bowstring onto the panel outer surface (115) instead of striking an end of the panel or being guided underneath the panel, wherein the panel (110) is constructed from a low-friction flexible material;

wherein the panel inner surface (116) is configured to be placed against the arm of the archer, wherein the panel anterior edge (111) is configured to be disposed proximate to a wrist of the archer, wherein the panel posterior edge (112) is configured to be disposed proximate to an elbow of the archer, wherein the panel (110) is configured to be held in place on the arm of the archer via a temporary attachment means (170) wherein the temporary attachment means (170) includes a first retaining strap (131) having a first strap first component (141) and a mated first strap second component (142), a second retaining strap (132) having a second strap first component (151) and a mated second strap second component (152) and a third retaining strap (133) having a third strap first component (161) and a mated third strap second component (162);

wherein a first series of perforations (172) is disposed on the panel (110) on an axis parallel to said panel first side edge (113), wherein a second series of perforations (172) is disposed on the panel (110) on an axis parallel to said panel second side edge;

wherein the trapezoidal panel (110) tapers in width from the panel posterior edge (112) to the panel anterior edge (111), wherein the panel posterior edge (112) is wider than the panel anterior edge (111);

wherein the panel (110) consists of a curved shape configured to match a shape of the arm of the archer from the panel first side edge (113) to the panel second side edge (114);

wherein the panel posterior edge (112) has rounded end corners, wherein each end corner of the panel posterior edge (112) extends past a midpoint of the panel posterior edge (112);

wherein the panel consists of a smooth finish;

wherein the panel (110) consists of a panel thickness (117) measured from the panel inner surface (116) to the panel outer surface (115) to be between 0.0005 inch and 0.5 inch;

a first aperture (121), a second aperture (122), a third aperture (123), and a fourth aperture (124), wherein the first aperture (121) is disposed on the panel (110) proximate to an intersection of the panel anterior edge (111) and the panel first side edge (113), wherein the second aperture (122) is disposed on the panel (110) proximate to an intersection of the panel anterior edge (111) and the panel second side edge (114), wherein the third aperture (123) is disposed on the panel (110) proximate to an intersection of the panel posterior edge (112) and the panel first side edge (113), wherein the fourth aperture (124) is disposed on the panel (110) proximate to an intersection of the panel posterior edge (112) and the panel second side edge (114);

wherein the first strap first component (141) is disposed in the first aperture (121), wherein the first strap second component (142) is disposed in the second aperture (122), wherein the second strap first component (151) is disposed in the third aperture (123), wherein the second strap second component (152) is disposed in the fourth aperture (124);

wherein the panel inner surface (116) is configured to be placed against the arm of the archer, wherein the panel anterior edge (111) is configured to be disposed proximate to the wrist of the archer, wherein the panel posterior edge (112) is configured to be disposed proximate to the elbow of the archer, wherein the first strap first component (141) and the first strap second component (142) are configured to be wrapped around the arm of the archer and are configured to be attached to hold the panel (110) in place on the arm of the archer, wherein the second strap first component (151) and the second strap second component (152) are configured to be wrapped around the arm of the archer and are configured to be attached to hold the panel (110) in place on the arm of the archer, wherein disposition of the first retaining strap (131) and the second retaining strap (132) on the outer surface (115) of the panel makes the panel conform to the shape of the arm when the first retaining strap (131) and the second retaining strap (132) are wrapped around the arm of the archer and the panel develops an arc-like cross-section with the concave posterior edge (112) sloping.

* * * * *